United States Patent [19]

Knapp

[11] Patent Number: 4,726,089

[45] Date of Patent: Feb. 23, 1988

[54] PIPELINE PIG CONSTRUCTION INCLUDING THREADED MANDREL AND NUT FOR SUPPORTING RESILIENT CUPS OR DISCS

[76] Inventor: Kenneth M. Knapp, 4018 W. Main, Houston, Tex. 77027

[21] Appl. No.: 922,203

[22] Filed: Oct. 23, 1986

[51] Int. Cl.[4] ..... B08B 9/04

[52] U.S. Cl. ..... 15/104.061

[58] Field of Search ..... 15/104.06 R, 104.06 A, 15/3.5, 3.51; 137/268; 166/153, 170

[56] References Cited

U.S. PATENT DOCUMENTS 3,604,041 9/1971 Ver Nooy ..... 15/104.06 R
4,275,475 6/1981 Schwartz et al. ..... 15/104.06 R
4,365,379 12/1982 Neff ..... 15/104.06 R
4,506,401 3/1985 Knapp ..... 15/104.06 R

*Primary Examiner*—Edward L. Roberts
*Attorney, Agent, or Firm*—Gunn, Lee & Jackson

[57] ABSTRACT

A pipeline pig is disclosed, the preferred embodiment incorporating all plastic components including a central elongate mandrel being hollow along the middle to a forward transverse partition, a nut which threads to the forward end of said mandrel, said nut and mandrel locking together to secure components on said mandrel. The device further supports N cups, the cups preferably backed by adjacent discs for stiffening purposes and being spaced along the mandrel by spacer means. Scrapper discs can be used with the leading disc being harder & smaller while scrapping discs are softer and larger.

19 Claims, 3 Drawing Figures

FIG. 1
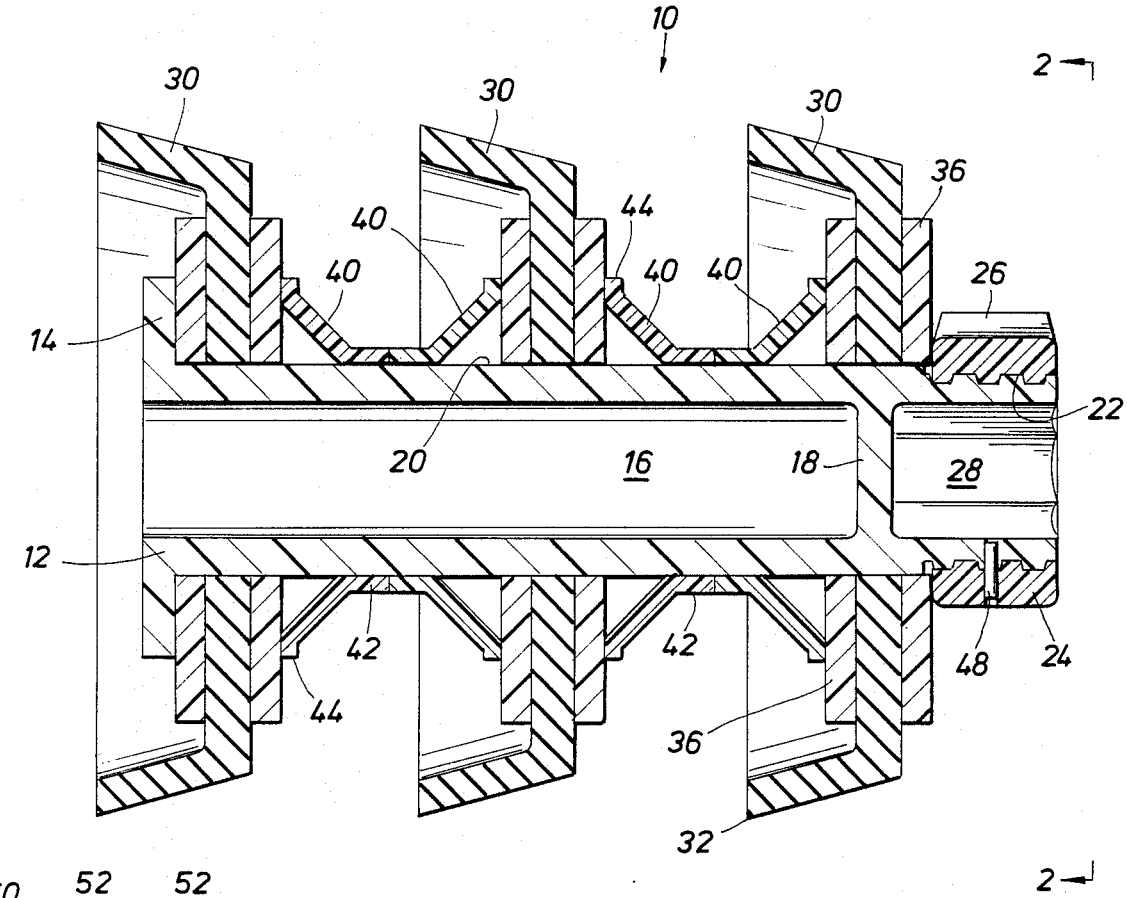
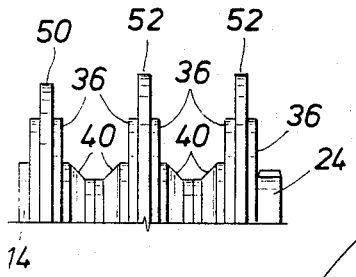
FIG. 3
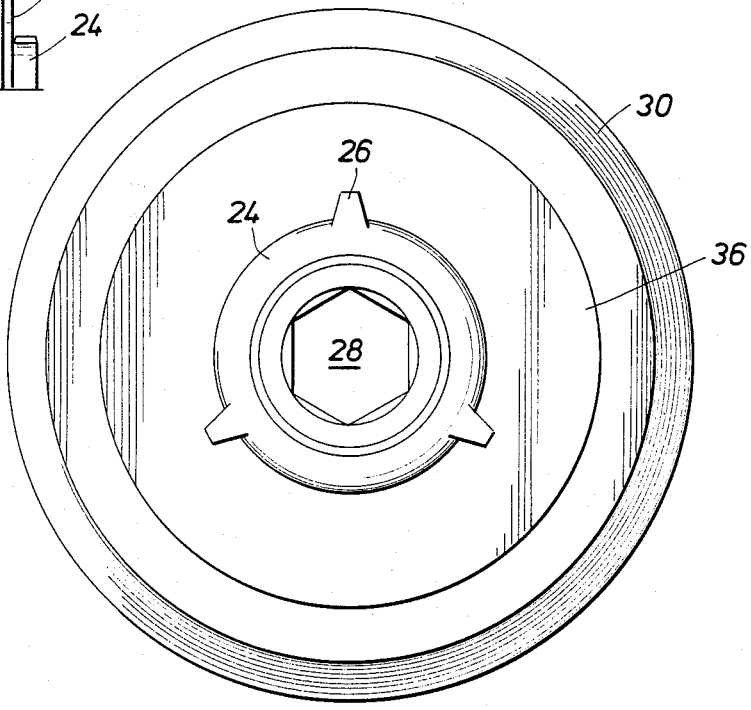
FIG. 2

PIPELINE PIG CONSTRUCTION INCLUDING THREADED MANDREL AND NUT FOR SUPPORTING RESILIENT CUPS OR DISCS

BACKGROUND OF THE DISCLOSURE

This disclosure is directed to a pipeline pig construction and more particularly to a pig constructed of plastic materials and assembled in such a fashion to prevent accidental disassembly in the pipeline. In recent pipeline construction techniques, the pipe has been improved by incorporating a thin plastic lining on the interior of the pipe. Before that, the interior was exposed metal susceptible of corrosion or perhaps the formation of scales. Such bare metal pipes have been improved significantly by the incorporation of plastic coating materials on the interior. In the older pipelines, metal cleaning devices could be incorporated in the pipeline pig. This was common place, particularly in the form of a steel post supporting wiper cups and the like. With the advent of a thin plastic coating, the apprehension has arisen that such metal components in pipeline pigs may be dangerous, perhaps detrimental to the quality of the coating material in the pipe. For these reasons, it is desirable to avoid placing metal components in pigs. Inevitably, while a cleaning pig may provide hundreds of miles of quality service, nevertheless, they may come apart in a pipeline. Metal used in the construction of the pig may then create a scratch or tear on the plastic coating or lining in the pipe, and thereby expose bare metal. When the metal is exposed, there is the risk of corrosion, rust or scale formation at that location. This may ultimately weaken the wall, and any such tear in the coating defeats the integrity of the coating material.

Attempts have been made in the past as evidenced by the structures set forth in U.S. Pat. Nos. 4,365,379 and 4,413,370. These devices show some effort in providing an all plastic pig mandrel construction. It is submitted that the present apparatus constitutes patentable subject matter over the structures of the two disclosures.

This disclosure sets forth a central mandrel cooperative with a nut for assembly of the pig. An important feature is the incorporation of the assembly nut in conjunction with a fastening pin located at the forward end of the pig. A single mandrel size can be used for a range of pipeline diameters. As an example, a central mandrel of perhaps 4 inches diameter can be used for pipe ranging from about 12 inches in diameter up to perhaps 20 inches in diameter. Such a conversion is simply made by installing larger diameter cups. The cups are replaceable sacrificial members. Multiple cups of identical construction are positioned on the pig body. They are reinforced and held in location by means of a spacer disc which provides backing to each cup. As desired, a spacer disc can be placed on each side of the cup to provide controllable stiffening. Moreover, the spacing between adjacent cups can be controllably fixed by placing a spacer sleeve around the mandrel. In the preferred construction, a single spacer sleeve is devised, and it can be stacked on the mandrel with only one between adjacent cups, or with two installed in the preferred arrangement of the components. The number of spacer sleeves can be varied to thus accommodate variations in the length of the assembled pig constructed on the central mandrel.

One very important feature of this apparatus is the ability to assemble a pig which is less likely to come apart. Where the pig is assembled by means of some type of clamp or nut construction at the rear of the pig body, disassembly is more likely. The present approach thus locates the assembly nut on the mandrel at the front end of the pig. Moreover, all the cups are held onto the mandrel by means of an enlargement having the form of a surrounding peripheral lip. The lip engages the last of the several cups and hence supports the entire stack of cups, discs and spacer sleeves. Thus, the number of cups can be increased from N where N is a whole integer equal to or greater than two and the length of the pig can be increased without limit.

Assembly is thus accomplished at the front end of the pig. To the measure that the pig is fairly large and hence requires substantial torque to install and remove a lock nut on the front end of the pig, the nut is threaded to the pig conveniently by including the protruding lugs on the nut to enable the nut to be hammered for installation and removal. This tends to twist the mandrel. The mandrel is constructed with an open-end socket at the front end to permit a nonround member to be inserted therein in the fashion of an Allen wrench. Of course, this can be increased in size so that a very large nonround opening is constructed to thereby secure the mandrel against rotation when the nut is being placed on the pig or removed from the pig body.

This type construciton enables manufacturing tolerance accumulation to be accommodated. For instance, when several cups (N=two or more) are assembled on a mandrel along with reinforcing discs and various spacer sleeves, the accumulation of tolerance can build up. If for instance the variations in construction are up to about 1/16th of an inch, one can hope that the total tolerance accumulation is substantially zero. There is however the risk that the accumulation will not be zero. With four cups, there are as many as 18 components assembled on the mandrel, and with five cups there are typically 23 parts on the mandrel. This number follows the relationship that the end cup is normally accompanied by two discs and one spacer, that being a total of four components, while intermediate cups typically are accompanied by an aggregate of five components. Suffice it to say, that on the accumulation of 18, 23 or 28 components, all with a nominal manufacturing tolerance in thickness, yields tolerance variation along a mandrel. This construction enables such tolerances to be accumulated and precise construction is therefore not required. That is, the nut that is used to assemble to the mandrel and thereby lock-down all the components can accommodate a great variation in assembly.

An alternate embodiment of the present disclosure utilizes multiple discs as the scrapping element. This contrast with the cups described above, and in the preferred embodiment, the forward or leading disc is made especially hard and is undersized or undergaged in contrast with the nominal ID of the pipeline. Additional discs are included which are made softer and they are also oversized relative to the nominal ID of the pipe.

SUMMARY OF THE PRESENT DISCLOSURE

This apparatus is therefore summarized as an all plastic, mandrel construction pig having a central mandrel supporting N (N is a whole number integer) wiper cups. Each cup has a peripheral lip for wiping the pipe. The cups are installed in quantity of N and each cup is preferably positioned adjacent to a spacer sleeve. The cups are reinforced by support discs preferably placed on opposite faces of the cups. Another important features is the incorporation of a rather coarse thread on the forward end of the mandrel. A large nut is threaded to it for assembly. They are threaded together to assemble the stack of components on the central mandrel. Conveniently, they can be held together by friction fit, but alternatively and in the preferred embodiment, they are joined together by placing a pin through the nut and sufficiently into the mandrel to lock so that the entire assembly is held together. The nut is located at the forward end of the pig, thereby isolating the nut from exposure to disassembly at the back end of the pig. The risk of disassembly is therefore reduced so that all the components hold together. In the preferred embodiment, it is made without metal.

DRAWINGS

So that the manner is which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through the pipeline pig of the present construction showing details of construction of the several components and assembly into a mandrel-type pig for cleaning the pipeline;

FIG. 2 is a view of the forward end of the pig including a lock nut threaded to the mandrel showing means for threading and unthreading the nut on the mandrel; and FIG. 3 is a side view of an alternate form of pig using discs instead of cups.

DETAILED DESCRIPTION OF THE PREFERRED EMBODIMENT

Attention is first directed to FIG. 1 of the Drawings where the numeral 10 identifies the improved pig of the present disclosure. This pig can be made in a variety of sizes including variations in length and diameter to accommodate a wide range of pigging operations. This structure incorporates a central mandrel 12 which has a large, radially outwardly extending stop disc 14 at the rear end. The various components are assembled on the mandrel. The mandrel is hollow along the center at 16. The mandrel is hollow, this passage terminating at a transverse wall 18. The passage along the length of the mandrel is conveniently circular for ease of manufacturing. It has an external cylindrical surface 20, this surface permitting various components to slide over it against the stop disc 14. It extends to the forward end where a set of threads 22 are formed on the exterior. The threads are relatively coarse to enable a nut 24 to be threaded onto the mandrel. The threads support the nut 24 in locked engagement to secure the various components on the mandrel. The mandrel in conjunction with the threaded nut holds the various components together in the assembled fashion shown in FIG. 1.

Going momentarily to FIG. 2 of the drawings, the nut 24 includes protruding lugs at 26 for easy removal of the nut, as occasioned by using a hammer to drive the nut on or off the mandrel. This is especially helpful in larger sizes where significant torque is required to thread and unthread the nut. The mandrel 12 includes a forward end recessed chamber or cavity 28 shown both in FIGS. 1 and 2. The chamber 28 is nonround, and is ideally shaped to receive a wrench or lock tool. As shown in FIG. 2 a hex tool can fit conveniently into the chamber 28. This nonround construction prevents twisting of the mandrel. Preferably, the mandrel and nut are made of resilient materials. Relatively hard plastics can be used to fabricate the components. To a measure, some type of polish is used to smooth the threads 22 and thereby assure that threaded engagement is accomplished with controlled friction. However, when the stack of components jams against the nut 24, it may be necessary to use a hammer or mallet on the projecting lugs 26 to drive the nut to a full shoulder locking position against the components.

Additional components in this structure include removable wiper cups 30. Several can be installed on the mandrel. In theory, only one need be installed but this defines a structure where the mandrel might wobble, and hence the minimum number of cups is two. By this definition, the preferred structure therefore supports N cups 30 where N is a whole number integer of two or more. The individual cups are formed with a hole to fit about the mandrel. The hole need not be dimensioned precisely the same as the dimensions of the mandrel so that there can be some play or looseness in fit. The cups have a surrounding peripheral lip at 32, the lip being set at a conic angle to enable wiping of the pipeline. The cup is resilient and therefore tends to flex. Some measure of stiffening is obtained by placing a disc 36 against the cup. The disc is duplicated so that there are front and back discs 36 for each cup. It will be observed that there are two discs adjacent to each cup, one on the forward side and one on the back side. This significantly assists in strengthening and reinforcing the respective cups so that they hold a controlled measure of stiffness. This assures a desirable wiping action in the pipe, the wiping action being obtained from all of the N cups. Several discs 36 thus provide reinforcing to their respective cups. Separate from this, the apparatus incorporates spacer sleeves 40. They are located between discs. They are preferably arranged in pairs. Because they are constructed in the symmetrical fashion illustrated, they can be placed forwards or backwards on the mandrel and therefore serve as abutting spacer sleeves as shown. This yields an arrangement where the spacer sleeves can be turned forwards and backwards as shown. The spacer sleeve is constructed with a narrow funnel shaped end at 42, and then flares out at surrounding lip at 44. This is used to backup the disc positioned adjacent thereto, the arrangement aligning the disc and associated cups so that wobble is prevented. The funnel shaped spacer sleeve thus assures a measure of alignment and stiffness to the assembled structure.

The present apparatus is assembled by sliding the components over the mandrel. They are stacked on the mandrel to the requisite length. To the extent that there is some variation in thickness and hence a requirement that the nut stand at a different height, this can be accommodated. It will be observed that the nut threads up against the top of the stack of assembled components and compresses the stack to hold it snug. Further, the nut is locked in position by means of a pin 48 which is driven into a suitable hole drilled into the nut. If desired, a hole can be drilled through the wall of the mandrel. An alternative arrangement is simply to drive the pin 48 through the hole in the nut 24 against the threads, jamming against the threads, and achieving a kind of friction lock. If this is adequate, it is then unnecessary to drill a hole through the mandrel. In view of the amount of friction that can be controllably changed by the shape of the thread as well as the clearance between nut and mandrel, the frictional engagement between the nut and the mandrel can be adjusted to thereby assure that the nut will not unthread during use. So to speak, the grip of the nut against the stack of assembled components forms a type of lock-washer thrusting up against the nut to assure that there is tension on the nut from the stacked components about the mandrel, thereby holding the nut in place.

In operation, the device of this disclosure is used in the following fashion:

Cups of a requisite diameter are selected. The cup dimensions (including thickness) the thickness of the discs 36 can be varied to adjust the number of cups on the mandre. While FIG. 1 shows three cups, the number can be increased from three to four as an example. The number and height of spacer sleeve 40 can be varied also. The several cups are assembled onto the mandrel by sliding them over the mandrel with appropriate discs and spacer sleeves therebetween. This forms the assembly as illustrated in FIG. 1 with the N cups likewise assembly on the device. When fully assembled, the system will then permit the nut to be threaded onto the mandrel. In ordinary circumstances, the nut can be theaded by hand up to a certain point. At some juncture, it will be necessary to utilize a mallet, driving the nut by pounding on the tabs 26 so that the nut is driven firmly against the stack of assembled components. At this juncture, this assembles the pig for insertion into a pipeline. It is then placed in the line and run through the line, clearing and cleaning the line with wiping action at the lips of the N cups. In general terms, this process continues until the cups are so badly worn that blow-by around the edge of the cups occurs, thereby creating excessive leakage. At this point, replacement can be achieved easily by disassembly on removal of the nut 24.

Nut removal and installation on large size devices typically is accomplished with the assistance of two hand tools. One is a mallet used to hammer the nut by pounding on the lugs to tighten and loosen the nut. Another tool is an Allen wrench sized and shaped to fit into the opening 28 to hold the device against rotation.

In the construction of this device, the transverse partition 18 causes a significant portion of the pushing force behind the pig to act on the forward end of the pig. This assists in pulling the front end of the pig, so to speak, thereby applying a stretching force to the pig. Such a stretching force aids in smooth passage of the pig along the pipe. Should the pig encounter a rough surface in the pipe, it may chatter or vibrate during passage. Such vibrations would ordinarily work loose most locking mechanisms. The locking mechanism of the present disclosure, however, primarily utilizing the axial load applied by the nut against the stacked components about the mandrel, does not tend to work loose. The grip of the nut is ordinarily sufficient to hold the nut to the mandrel and avoid disassembly. Even where such disassembly might occur, the friction between the threads is normally sufficient to prevent working loose. As an added safety factor, the pin 48 is added by driving the pin through the nut. If desired, the pin can be driven all the way through the nut and into the wall of the mandrel. This assures locking of the nut while compressing the stack of components about the mandrel.

Imagine for the moment that the nut were to fall completely off the device. The tendency of the components is to stay together. That is, the pushing force applied by the flowing fluid in the pipeline impacts the rear portion of the equipment and acts on the back cup 30 as well as the mandrel at the mandrel partition 18. This applies a tension force which tends to pull the mandrel forward. This tends to hold the stack of components onto the pig and prevents shedding of components. This is particularly advantageous over pigs which fasten at the back end. Such a pig construction is assured to come apart in the unanticipated failure of the fastening device.

Going now to typical materials, all the components are preferably made of plastic materials. The preferred plastics include materials such as relatively hard polyurethane of relatively high density. The hardness or durometer (Shore A test) can range from perhaps 80 to 95 durometer for the cups. Greater hardness can be obtained but it is generally not needed. The lip 32 around the cup is preferably made fairly resilient so that it tends to flex and assures a wiping action in the pipe. By contrast, the nut can be made harder than the mandrel by perhaps five to 15 durometer. The mandrel 12 is normally harder than the cups. The threads are typically Acme thread with the typical pitch being about two threads per inch on sizes up to about 10 or 12 inches, and about one thread per inch for larger sizes. This assures a sufficient grip between nut and mandrel to thereby provide a firm grip between the nut and mandrel.

One alteration that can be implemented in the present apparatus is to construct as an interval component the individual discs 36 along with the spacers 40. That would define a type of spool having the outwardly extending peripheral lip obtained from combining these two components. Such a device could be made by simply casting the two components together so that a single component is performed thereby. This might reduce the number of components but it typically requires a more expensive mold.

Attention is now directed to FIG. 3 of the drawings which shows an alternate form of the present apparatus. There, the numeral 12 again identifies the mandrel constructed in accordance with the teachings of FIG. 1 and it is fastened at the end with a nut 24 in the same fashion. It supports a number of spacers 40 which are similar to those shown in FIG. 1. The spacers cooperate with a set of backing discs 36 in the same fashion as shown in FIG. 1. The primary difference in the construction of FIG. 3 is that the pig is formed with scrapper discs as opposed to scrapper cups. More importantly, the disc come in two sizes. The forward or leading disc and the trailing disc are identified by the numerals 50 while an alternate size and form of disc is identified at 52. These discs will be described in detail below.

The leading and trailing discs are the version at 50. This disc is made smaller or undergage for the pipe nominal diameter. In contrast with this the disc 52 serves as a scrapping disc. It is larger in diameter than the disc 50. While both can be made of typical polyurethane materials, they differ in hardness. The disc 52 has a typical hardness in the range of about 65 to 75 durometer (Shore A test). The difference in hardness is about 20 or more units. Thus, the disc 50 is in the range of about 90 to 95 durometer. The disc 52 is overgage in comparison with the nominal diameter of the pipe.

Compared with the nominal diameter of the pipe, the leading disc is thus undergage by about 0.01" to about 0.05". This range yields an undergage disc (recall that it is made of harder material) that aligns the pig and guides it through the pipeline. In ordinary circumstances, it will not wear rapidly by virtue of being undergage. By contrast, the disc 52 (not located at the leading or trailing end of the pig) is oversize but made of softer material. It is overgage by a distance which is typically about 0.02" or greater. This is the minimum overgage which will provide some benefit. The maximum overgage is given by the relationship of 0.02" plus pipe ID times 0.01" to about 0.02". To consider an example, a 12" pig would have overgage discs 52 that are in the range of 0.02" up to about 0.26" overgage. This is a typical range for a 12" pig. For a 20" pig, the range would be from about 0.02" up to about 0.42".

In an ordinary pig construction, it is not necessary that the last disc be made smaller and harder. It is very important to make the leading disc undergage and somewhat harder. Accordingly, the scrapper discs are all oversize and made of softer material as described above. It is a matter of convenience whether or not the last or trailing disc is made undergage and of harder materials.

The pig FIG. 3 is assembled in the same fashion as the pig shown in FIG. 1. The primary difference is the use of removable discs, especially those of differing diameters and hardness, thereby yielding the asesmbled pig of the present disclosure.

An important factor arising from the construction set forth herein is ease of handling. For instance, a 24" pig with four scrapper cups is quite heavy and typically requires two or more men to handle during disassembling. Those made with metal mandrels and the construction presently in vogue utilizing nuts and bolts typically require perhaps ten or more bolts to join each disc or cup for such a large size. A four cup pig weighing over 200 lbs and equipped with nearly 100 bolts requires substantial hand labor to disassemble and replace the cups. This is especially true in view of the damage that is suffered by the assembly bolts for holding the wiper cups or discs on the pig. They will typically be bent and distorted in some fashion, making unthreading very difficult. In fact, it can easily require several hours for two men utilizing an impact wrench to remove the nuts and bolts, dismount the worn cups or discs. and reassembly with new cups or discs. By utilizing the construction shown in the drawings, disassembly and replacement of worn parts can be accomplished much more rapidly. Further, the large pig is much lighter to handle and can be more quickly restored to service.

While the forewarning is directed to the preferred embodiment, the scope is determined by the claims which follow:

What is claimed is:

1. A pipeline pig, comprising:

(a) an elongate mandrel having a back end and front end, the back end including a first shoulder for registering components placed thereon and wherein front end is sized to permit components to slide thereover;

(b) at least N pipe contacting cups having an outer peripheral lip thereon, each of said cups having a central opening therein sized to fit about said mandrel;

(c) means fitting on the exterior of said mandrel for spacing said N cups along said mandrel;

(d) fastener means releasably connected to said mandrel, said fastener means:

(1) fastening to the front end of said mandrel;

(2) selectively removable therefrom;

(3) exteriorly located on said mandrel and bearing against the components placed on the exterior of said mandrel to apply a locking force there against;

(4) sized to lock components after installation on said mandrel; and (e) wherein said mandrel and all components thereon are made of resilient material.

2. The apparatus of claim 1 wherein said fastener means comprises a nut engaging a set of threads formed on the exterior of said mandrel, said nut having an abutting shoulder adapted to contact components on the exterior of said mandrel.

3. The apparatus of claim 2 wherein said mandrel is axially hollow and has a transverse partition thereacross at the forward end of said mandrel, said partition being exposed to pressure applied in the pipeline to the rear of the pig to thereby apply a force near the forward end of the pig to create a pulling force acting on the pig.

4. The apparatus of claim 1 including a nonround opening in the front end of said mandrel adapted to receive a hand tool therein to hold said mandrel against rotation and wherein said fastener means comprises a nut threading about said mandrel, and including means on the exterior of said nut permitting tool engagement to thereby rotate said nut relative to said mandrel.

5. The apparatus of claim 4 wherein said nut includes external lugs thereon enabling tool engagement and wherein said nonround opening is shaped to receive a hexshaped tool.

6. The apparatus of claim 5 wherein said nut and said mandrel thread together at matching threads and further including a locking pin joining said nut to said mandre.

7. The apparatus of claim 1 further wherein said N cups are stacked along said mandrel from said first shoulder, and are removable only on removal of said fastener means.

8. The apparatus of claim 7 wherein said fastener means is about 5 to 15 durometer harder than said mandrel and joins thereto by a set of mating threads.

9. The apparatus of claim 8 wherein said mandrel is about 80 to 95 durometer hardness.

10. The apparatus of claim 9 wherein said spacing means is an elongate hollow sleeve having a funnel shaped end and a wide opposite end with a second shoulder adapted to abut components around said mandrel.

11. A pipeline pig, comprising:

(a) an elongate mandrel having a back end and front end, the back end including a first shoulder for registering components placed thereon and wherein front end is sized to permit components to slide thereover;

(b) at least N pipe contacting means having an outer peripheral lip thereon, each of said N means having a central opening therein sized to fit about said mandrel;

(c) spacing means fitting on the exterior of said mandrel for spacing said N means along said mandrel;

(d) fastener means releasably connected to said mandrel, said fastener means:

(1) fastening to the front end of said mandrel;
(2) selectively removable therefrom;
(3) exteriorly located on said mandrel and bearing against the said spacing means and N means placed on the exterior of said mandrel to apply a locking force there against;
(4) sized to lock said spacing means and N means after installation on said mandrel; and
(e) wherein said mandrel, spacing means and N means thereon are made of resilient material.

12. The apparatus of claim 11 wherein said fastener means comprises a nut engaging a set of threads formed on the exterior of said mandrel, said nut having an abutting shoulder adapted to contact spacing means and N means on the exterior of said mandrel.

13. The apparatus of claim 11 wherein said mandrel is axially hollow and has a transverse partition thereacross at the forward end of said mandrel, said partition being exposed to pressure applied in the pipeline to the rear of the pig to thereby apply a force near the forward end of the pig to create a pulling force acting on the pig.

14. The apparatus of claim 11 including a nonround opening in the front end of said mandrel adapted to receive a hand tool therein to hold said mandrel against rotation and wherein said fastener means comprises a nut threading about said mandrel, and including means on the exterior of said nut permitting tool engagement to thereby rotate said nut relative to said mandrel.

15. The apparatus of claim 14 wherein said nut includes external lugs thereon enabling tool engagement and wherein said nonround opening is shaped to receive a hex-shaped tool.

16. The apparatus of claim 15 wherein said nut and said mandrel thread together at matching threads and further including a locking pin joining said nut to said mandrel.

17. The apparatus of claim 11 wherein one of said N means is a leading disc which is undergaged in the range of about 0.01" to about 0.05".

18. The apparatus of claim 17 wherein at least one of said N means is an intermediate disc overgaged by at least 0.02".

19. The apparatus of claim 18 wherein said intermediate discs are overgage by at least 0.01" and up to 0.01" plus 0.01" times pig diameter and are less than 1.00" overgage.

* * * * *